United States Patent [19]

Robertson et al.

[11] Patent Number: 4,995,252

[45] Date of Patent: Feb. 26, 1991

[54] METHOD AND APPARATUS FOR INTERNALLY ENHANCING HEAT EXCHANGER TUBING

[75] Inventors: Gerald F. Robertson, Manlius; Ross A. Moyer, LaFayette; John R. McManus, Marcellus, all of N.Y.

[73] Assignee: Carrier Corporation, Syracuse, N.Y.

[21] Appl. No.: 319,363

[22] Filed: Mar. 6, 1989

[51] Int. Cl.[5] ..... B21C 37/20

[52] U.S. Cl. ..... 72/194; 72/198

[58] Field of Search ..... 72/76, 190, 191, 193, 72/194, 197, 198, 209

[56] References Cited

U.S. PATENT DOCUMENTS

| | | | |
|---|---|---|---|
| 771,611 | 10/1904 | Davis | 72/190 |
| 1,622,744 | 3/1927 | Stiefel | 72/190 |
| 3,143,009 | 8/1964 | Pfeiffer | 72/191 |
| 3,422,518 | 1/1969 | French | 72/209 |
| 3,566,651 | 3/1971 | Tlaker | 72/76 |
| 4,715,205 | 12/1987 | Fazan | 72/198 |

FOREIGN PATENT DOCUMENTS

| | | | |
|---|---|---|---|
| 3715393 | 2/1988 | Fed. Rep. of Germany | 72/96 |

*Primary Examiner*—Lowell A. Larson

*Attorney, Agent, or Firm*—Wall & Roehrig

[57] ABSTRACT

A method and machine for forming internal enhancement ribs in heat exchanger pipe or tubing comprises a mandrel which is supported within the tubing and a plurality of opposed rotary dies which have their axes perpendicular to the tube axis so that they rotate in the direction parallel to the tube axis. The rotary dies have a circumferential contact portion that has a concave arcuate profile. In one embodiment, the circumferential surface is scalloped with a succession of axially raised portions. In another embodiment, the rotary die carries a plurality of circumferential rollers.

20 Claims, 4 Drawing Sheets

METHOD AND APPARATUS FOR INTERNALLY ENHANCING HEAT EXCHANGER TUBING

BACKGROUND OF THE INVENTION

This invention relates to a process and apparatus for embossing the internal surface of heat exchanger tubing to produce ribs or grooves thereon.

In the tubing of an air conditioner condenser coil, evaporator coil, or other heat exchanger, it is preferred that the inner surfaces of the tube be provided with ribs or the like to increase its surface area and to increase the efficiency in condensing or evaporating a refrigerant fluid.

A machine for grooving or embossing the inner surface of heat exchanger tubing, which can be a copper pipe, is conventionally constructed by combining a more-or-less standard tube drawing machine with a draw bench, an outer doughnut-type die, and an inner die having a grooved surface which produces the rib enhancement on the pipe inner surface. A plurality of rollers or balls rotate planetarily, that is, in a circumferential direction, around the part of the pipe where the grooving die is positioned.

There is normally a tremendous stress in the pipe caused by the compression of the tube by contacting of the rolls with the internal die. This is compounded by the small contact area, which requires small leads to be employed. Processing speed is affected, which therefore must be undesirably low. This raises the cost of processing the copper pipe.

An embossing machine which employs planetarily rotating balls for sinking the tubing into the internal die are contained in a head that rotates coaxially with the pipe or tube. One such construction is described in U.S. Pat. No. 4,373,366.

It should be noted that that embossing machine, because of the generally circumferential motion of the ball-type pressing members, is suitable for producing spiral or helical bosses, but seems less adequate for axial internal grooves, fluting, or ribs. Also, whether or not desired, there are spiral grooves produced on the outer surface of the tube due to the generally spiral motion of the balls.

It is desired to replace the conventional process of tube sinking onto an internal die or mandrel. More particularly, it is desired to replace the conventional rotary die with a plurality of rotating die members which roll into contact with the tube in a direction parallel to the movement of the tube.

OBJECTS AND SUMMARY OF THE INVENTION

It is an object of this invention to provide a method and apparatus to "sink" a heat exchanger tube onto an internal die or mandrel, to emboss the internal tube surface and increase the effective surface area and heat transfer properties of the tube.

It is a more specific object of this invention to provide a method that avoids excessive axial forces typical of conventional draw die reduction, and which further avoids throughput reduction that is characteristic of the circumferentially rotating balls, rollers, and the like.

It is another object of this invention to provide a technique for sinking tubing into an internal enhancement mandrel by alternately squeezing and releasing the tube, to alternate rapid slip-and-stick motion. This effectively works the metal into the grooves in the mandrel, and thereafter releases the same from frictional hold, so that the tube can be readily advanced ar an economically practicable speed.

In accordance with one aspect of this invention, a method for producing the internal enhancement involves moving the heat exchanger tubing or pipe axially over a generally cylindrical mandrel that is supported within the tube or pipe at a substantially stationary position, and then sinking the tubular heat exchanger pipe into grooves on the mandrel to produce internal ribs or axial grooves at the locations of the grooves. The tube sinking is carried out by rotating a plurality of pairs of opposed rotary dies against the outer surface of the pipe at the locations of the mandrel. The dies are in the form of wheels that have their axes disposed generally perpendicular to the pipe axis, and have circumferential portions that roll into contact with the pipe parallel to the axis of the pipe. The circumferential portions of the rotary dies have a concave face profile that defines an arc substantially equal to 360 degrees divided by the number of these dies. For example, in the preferred embodiments there are four dies spaced at 90 degrees apart, and each has a contacting face profile that defines a 90 degree arc.

The outer or circumferential portions of the rotary dies effect an incremental beating by contacting and releasing the outer surface of the pipe. For this purpose, the rotary dies can have a scalloped circumferential surface, or can have a generally regular circular surface with ultrasonic release to and from the pipe outer surface, or can be formed of a main wheel carrying a plurality of circumferential rollers.

In embodiments of this invention, tube output speeds from about five feet per minute up to about one hundred fifty feet per minute or greater can be achieved if desired, an axial enhancement can be embossed on the outer surface of the pipe simply by allowing a small gap between adjacent ones of the rotary dies. An external enhancement can be effected by embossing, and can also be done in various patterns by using textured roller surfaces.

The above and many other objects, features, and advantages of this invention will be more fully understood from the ensuing description of preferred embodiments of this invention, which should be considered in connection with the accompanying drawing.

DETAILED DESCRIPTION OF THE PREFERRED EMBODIMENTS

Figure 1:
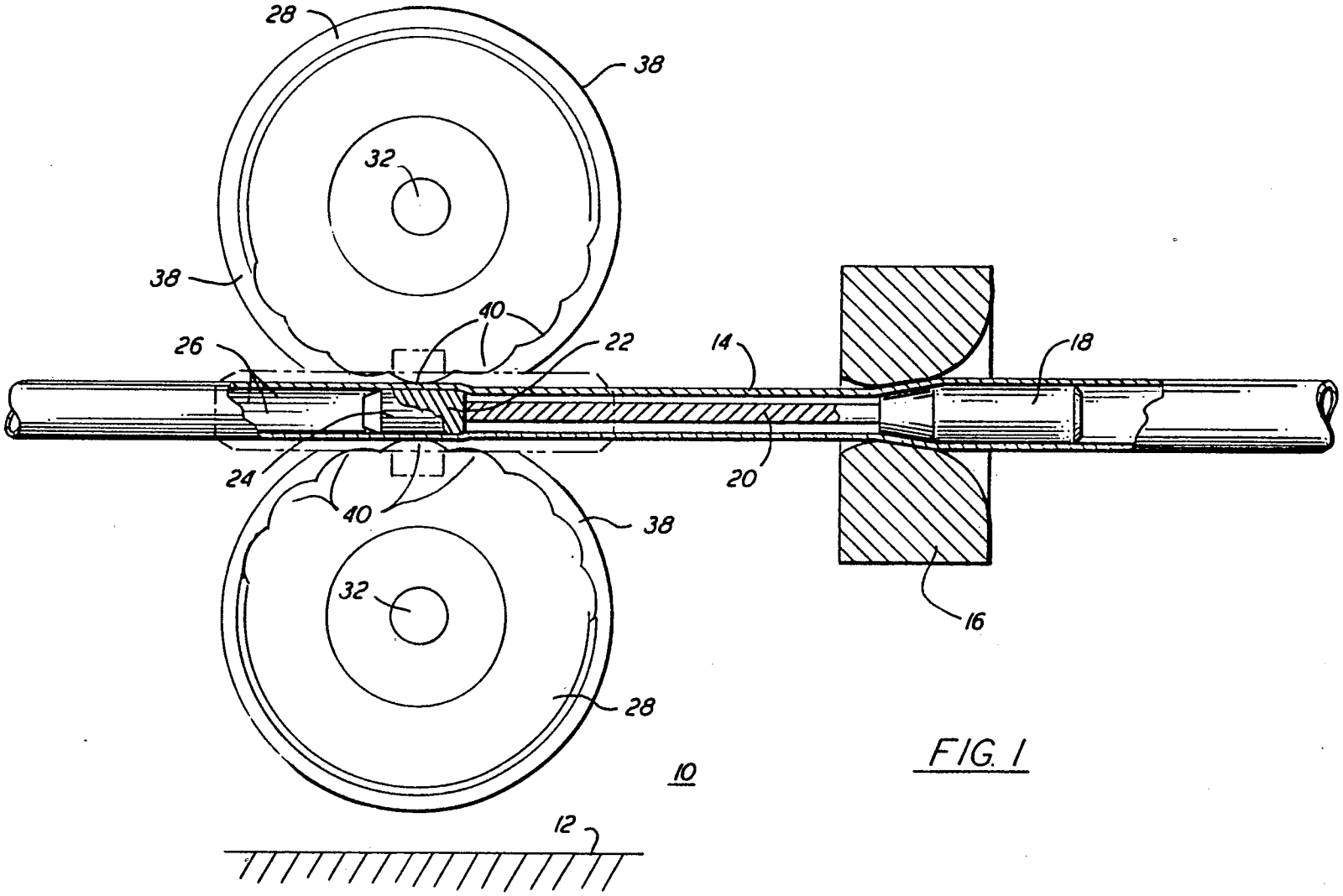
FIG. 1 is a schematic elevational section of a tube drawing and embossing machine according to a first embodiment of this invention.
Figure 2:
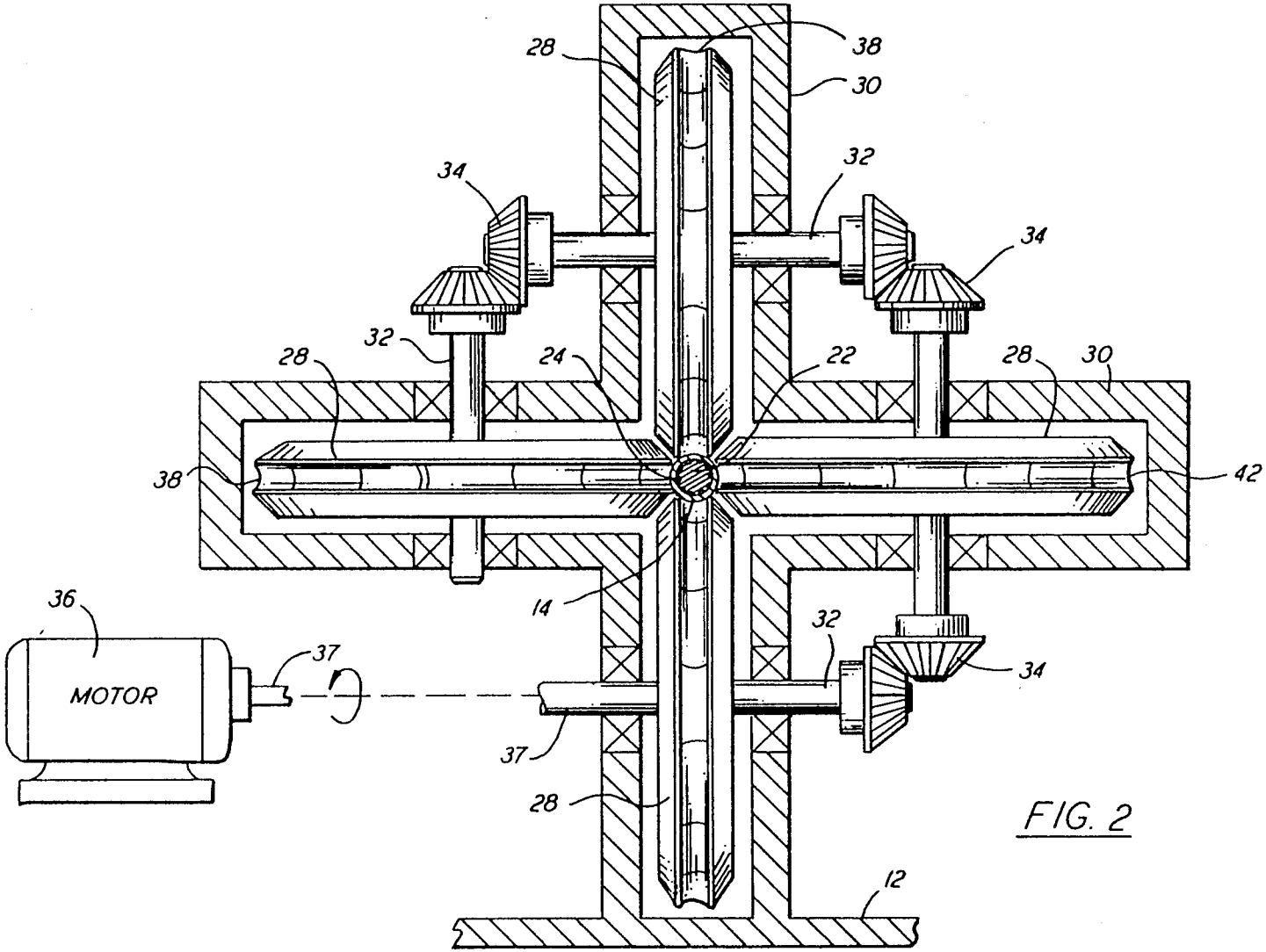
FIG. 2 is an end sectional view of the first embodiment of this invention.

With reference to the drawing, and initially to FIG. 1, an embossing machine 10 according to this invention comprises a draw bench 12, which represents means for effecting axial movement of a heat exchanger tube or pipe 14. The drawbench can be another tube drawing machine, i.e. a bull block, falling block, etc. Such pipes are generally copper tubing, but could be pipes of other metal. The pipe 14 passes through an annular reducing die 16 in which there is seated an internal "floating" plug. This plug 18 supports a rod 20 which passes downstream within the pipe 14. A cylindrical mandrel or "bullet" die 22 is mounted at the distal end of the rod 20, and is free to rotate on the rod. On the outer, or cylindrical surface of the mandrel 22, there are spaced apart grooves 24, which can be either straight axial groves, as shown, or angled helical grooves, but which extend from the proximal to the distal end portions of the mandrel 22. The metal of the pipe 14 is "sunk" or forced radially inwards into the mandrel grooves 24 to produce axial ribs 26 as an internal enhancement within the tube or pipe 14. To effect the "sinking" of the pipe 14 into the mandrel 22, there are provided a plurality of rotary dies 28, that is, wheels that are mounted in a support 30 (FIG.2) so that the axes 32 of the dies 28 are disposed or oriented in the direction perpendicular to the tube or pipe. A gearing mechanism 34 rotationally synchronizes the dies 28 so that they all rotate at the same speed. A motor 36, which can be, for example, an electric or hydraulic drive device, is coupled by a shaft to the mechanism 34 for driving the rotary dies 28 in a manner that permits their speed to be controlled with the axial speed of the pipe 14 along the draw bench 12. The dies 28 each are of unitary construction and have a circumferential face portion 38 which rolls into contact with the outer surface of the tube or pipe 14. In this embodiment, the circumferential face 38 is scalloped or undulating, comprising a succession of radially raised portions 40 which are separated by radially lower portions. As shown in FIG. 2, for example, the circumferential portion 38 has a profile 42 which is a ninety degree arc or quadrant, so that the four dies 28 together contact substantially three hundred sixty degrees of the circumference of the pipe or tube 14. An axial external enhancement can be achieved if desired, by allowing a small space in between each successive one of the dies 28, or otherwise circumferentially grooving the dies 28.

In this embossing machine 10, the dies 28 roll against the outer surface of the pipe 14, and the intermittent striking of the raised portions 40 of the scalloped circumferential face 38 causes the metal of the pipe 14 to alternately grip and release the grooved mandrel 22. This causes the metal on the inner surface of the pipe 14 to flow into the grooves 24 on the mandrel to form the ribs 26, and then permits the pipe 14 to spring away from the mandrel 22 so that the pipe 14 can move axially for a short increment. The rotary dies 28 can turn in the direction so that the circumferential faces 38 thereof strike the pipe outer surface in the same direction as the pipe travel, or can turn in the direction opposite to the pipe travel. Rotation speed and direction will depend on such parameters as tube wall thickness and height of the internal enhancement.

Figure 3:
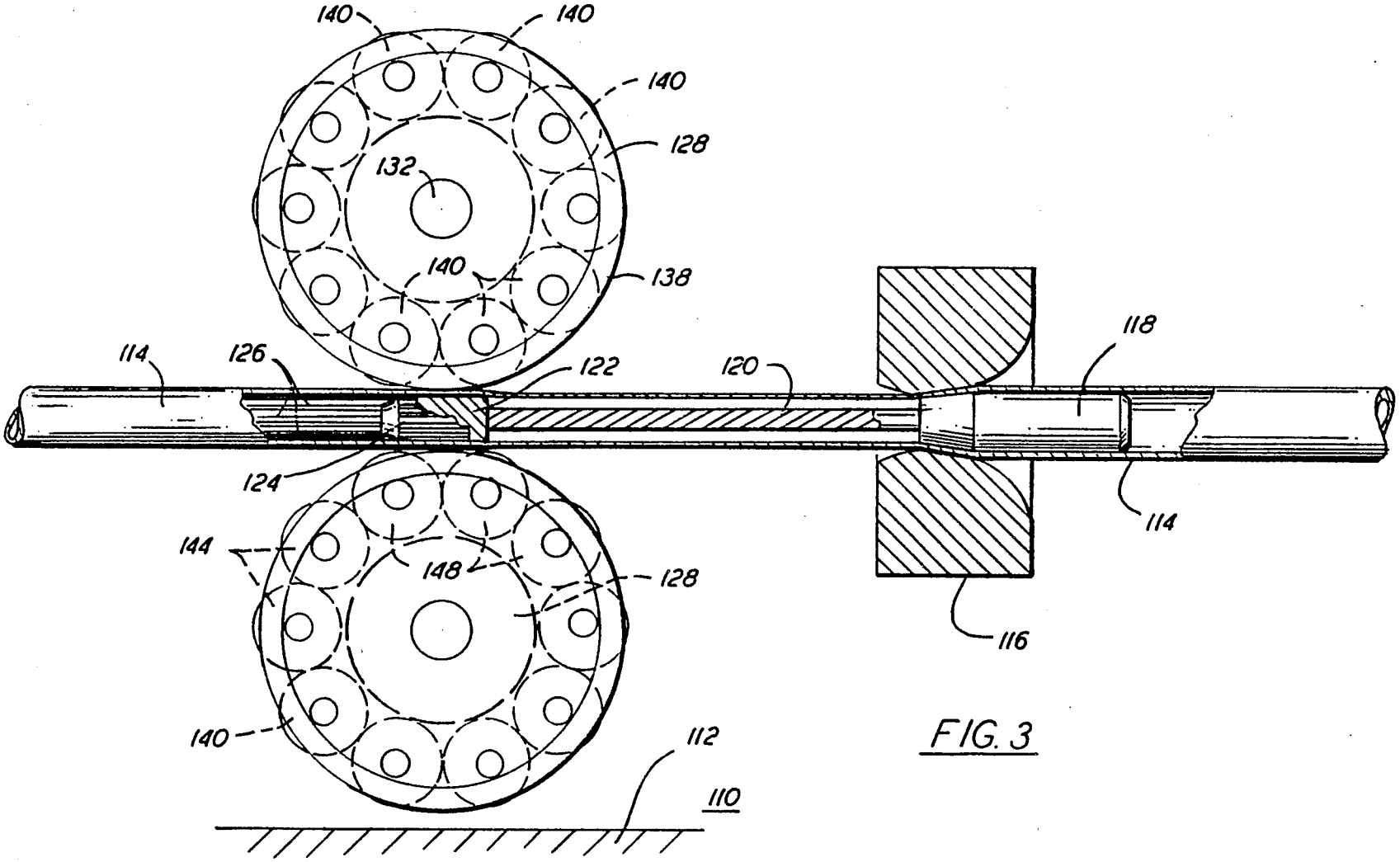
FIG. 3 is a sectional side elevation of a second embodiment of this invention.

A second embodiment is illustrated with reference to FIG. 3, in which elements there illustrated, like those of the first embodiment are identified with the same reference numbers, but raised by 100. Here, an embossing machine comprises a draw bench or the like 112 on which a tube or pipe 114 for a heat exchanger is moved through an annular reducing die 116 that restrains a floating plug 118 which is connected by a rod 120 to an internal embossing mandrel 122. The latter contains axial grooves 124 which produce axial ribs 126 on the interior surface of the tube 114.

Figure 4:
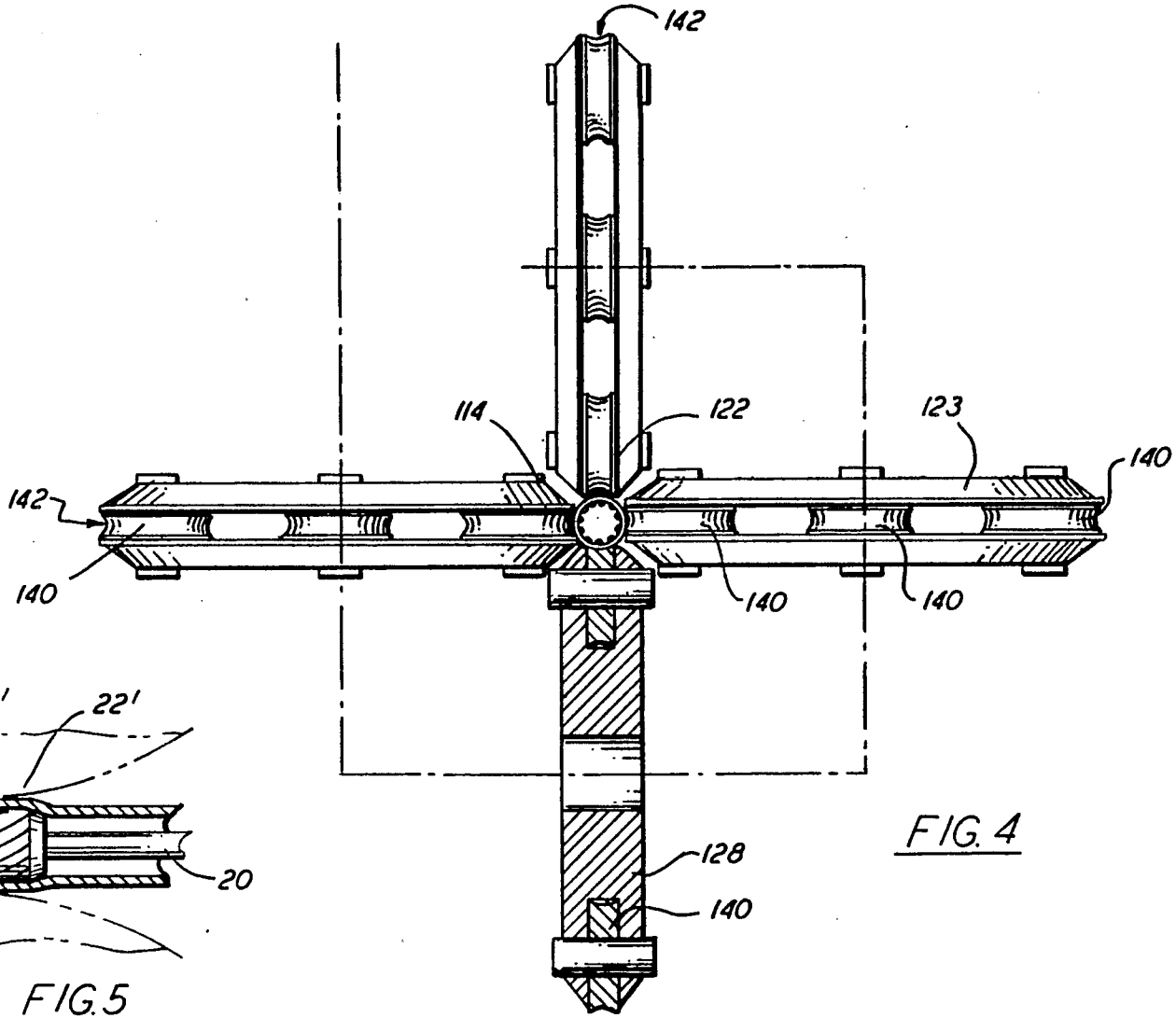
FIG. 4 is an end view of the second embodiment of this invention.

As in the first embodiment, there are four rotary dies 128, spaced at ninety degree intervals around the tube 114, as shown in FIG. 4. As with the first embodiment, the axes 132 of the rotary dies 128 are oriented in the direction perpendicular to the axis of the tube or pipe 114. The support for the rotary dies 128, as well as gearing and drive mechanisms, being similar to those of the first embodiment, are omitted from the drawing in FIG. 2.

In this second embodiment, the rotary dies 128 are in the form of wheels whose circumference 138 contains a plurality of rollers 140. The latter have axes parallel to the die axis 132. As shown in FIG. 4, the rollers 140 each have a face profile 142 that is substantially a ninety degree arc, so that the corresponding rollers 140 that contact the pipe 114 at any one time occupy substantial three hundred sixty degrees of the circumference of the tube 114.

In this embodiment, there are ten rollers 140 for each wheel or die 128. However, the number of such rollers can be selected according to standard engineering principles, depending on the tubing diameter and wall thickness, and according to the required speed of tube output. Tube output speeds of anywhere between about five feet per minute and one hundred fifty feet per minute can be expected with this embossing machine 110.

It is preferred that the rotary dies 128 in this embodiment be rotated in the direction against the direction of travel of the tube or pipe 114 past the mandrel 122.

As with the first embodiment, the rollers 140 successively contact the pipe wall and urge the metal of the pipe to flow into the grooves 124 in the mandrel 122, and then release the pipe 114 so that the pipe wall will spring back away from the metal permitting the pipe to advance.

The incremental beating of the rollers 140 on the pipe 114 can create physical waves on the outer surface of the tube or pipe 114. By rotating the dies 128 in the direction against pipe travel, the successive waves will tend to cancel one another out, keeping the undulation effect to a minimum.

With both the first and second embodiments, the dies 28 and 128 are synchronized so that the several dies for each machine 10 and 110 contact the pipe 14 or 114 together, and cooperate to create a succession of rapid grip and release occurrences between the tube and mandrel. In one practical version of the embodiment of FIGS. 3 and 4, the rotary dies 128 can be constituted by a twelve inch diameter wheel, each with fifty-one rollers 140 of 0.7 inch diameter. An output speed of one hundred feet per minute can be achieved at a die rotation speed of about twelve thousand RPM. In another verstion, the dies 128 can be six inch diameter wheels containing seventeen rollers each, of 0375 inch diameter. If these dies 128 are rotated at about forty-four thousand RPM a one hundred twentyfive feet per minute output speed is obtained. In each case, there is an incremental beating such as to create a tube feed or advance of about two thousandths of an inch per roller 140.

Figure 5:
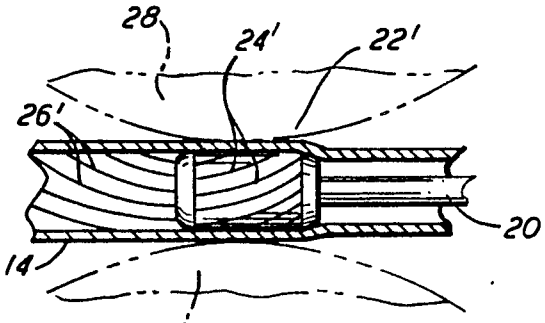
FIG. 5 is a partial sectional view showing an alternative mandrel.

An alternative helically grooved mandrel 22' as shown in FIG. 5, has helical or spiral grooves 24' which extend from a proximal to a distal end thereof. This can replace the axially grooved mandrel 22 or 122. The helical grooves produce helical tube enhancement ribs 26' on the interior surface of the tube or pipe 14. In this case, the mandrel 22' rotates to follow the course of the ribs 26' as the tube 14 is drawn over it.

While this invention has been described in detail with respect to certain preferred embodiments, it should be understood that the application is not limited to those precise embodiments. Rather, many modifications and variations would present themselves to those of skill in the art without departing from the scope and spirit of this invention, as defined in the appended claims.

What is claimed is:

1. A method of producing an internal enhancement on a metal tubular heat exchanger pipe which comprises the steps of moving the pipe axially over a generally cylindrical mandrel that is supported within the pipe at a substantially stationary position, the mandrel having a plurality of grooves therein that extend from one axial end to another axial end thereof; and sinking the tubular heat exchanger pipe into the grooves on the mandrel to produce internal ribs at the locations of said grooves, by rotating a plurality of pairs of opposed rotary dies to strike against the outer surface of the pipe all at one transverse plane substantially at the location of said mandrel, said dies being in the form of wheels having axes generally perpendicular to the axis of the tubular heat exchanger pipe and having circumferential portions which roll into contact with the pipe parallel to the axis of the pipe at said transverse plane, so that the dies together strike the pipe over substantially its entire circumference at said transverse plane.

2. The method of claim 1 wherein each of said rotary dies occupies an arc of the circumferences of the heat exchanger pipe substantially equal to 360 degrees divided by the number of said dies, so that substantially the entire circumference of the outer surface of pipe is contacted by said dies.

3. The method of claim 2 wherein there are two pairs of said opposed dies disposed at 90 degree intervals about the pipe, and wherein each of said rotary dies occupies an arc of substantially 90 degrees of the circumference of the pipe.

4. The method of claim 1 wherein said rotary dies are unitary and have a generally scalloped undulating circumferential surface, and said step of rotating said dies includes intermittently contacting the outer surface of the pipe with radially raised portions of the scalloped circumferential surface.

5. The method of claim 4 further comprising synchronizing said rotary dies to rotate together so that the dies simultaneously engage and then simultaneously disengages the outer surface of the pipe alternately.

6. The method of claim 1 wherein said rotary dies each carry a plurality of circumferential rollers, and said step of rotating the dies includes intermittently contacting the outer surface of the pipe with said rollers.

7. The method of claim 6 further comprising synchronizing said rotary dies to rotate together so that said rollers of the respective dies simultaneously engage and then simultaneously disengage the outer surface of the pipe.

8. The method of claim 1 wherein said dies are rotated so that the circumferential portions thereof roll into contact in the direction of movement of the pipe with respect to the mandrel.

9. The method of claim 1 wherein said mandrel grooves are axial.

10. The method of claim 1 wherein said mandrel grooves are helical.

11. A method of producing an internal enhancement on a metal tubular heat exchanger pipe which comprises the steps of moving the pipe axially over a generally cylindrical mandrel that is supported within the pipe at a substantially stationary position, the mandrel having a plurality of grooves therein that extend from one axial end to another axial end thereof; and sinking the tubular heat exchanger pipe into the grooves on the mandrel to produce internal ribs at the locations of said grooves, by rotating a plurality of pairs of opposed rotary dies against the outer surface of the pipe substantially at the location of said mandrel, said dies being in the form of wheels having axes generally perpendicular to the axis of the tubular heat exchanger pipe and having cricumfernetial portions which roll into contact with the pipe parallel to the axis of the pipe; wherein said dies are rotated so that the circumferential portions thereof roll into contact against the direction of movement of the pipe with respect to the mandrel.

12. A machine for forming an internal enhancement on an inner surface of a metal tubular heat-exchanger pipe comprising means for advancing said pipe axially;

a generally cylindrical mandrel within said pipe and having a plurality of axial grooves thereon;

a plurality of pairs of opposed rotary dies in the form of wheels having respective axes disposed generally perpendicular to the axis of the heat exchanger pipe and having circumferential portions which roll into contact with the pipe parallel to the axis of the pipe substantially at one transverse plane at the location of aid mandrel; means supporting the axes of said rotary dies so that the dies are in opposition and surround the pipe, the circumferential portions of the several rotary dies occupying respective arcs of the outer surface of the pipe so that substantially the entire circumference of the outer surface of the pipe is contacted by said dies; and means for rotating said rotary dies so that said circumferential portions thereof each simultaneously roll into contact with said pipe when said pipe is being advanced; so that the dies together impact substantially the entire circumference of the pipe at said transverse plane.

13. The machine of claim 12 wherein said rotary dies are unitary and have generally scalloped undulating circumferential surfaces with radially raised portions which contact the outer surface of the pipe inturn as the dies rotate.

14. The machine of claim 13 further comprising synchronized drive means for rotating said rotary dies at the same speed so that the dies simultaneously move their respective raised portions into contact and then out of contact with the outer surface of the pipe.

15. The machine of claim 12 wherein said rotary dies each carry a plurality of circumferential rollers which contact the outer surface of said pipe in turn as the dies rotate.

16. The machine of claim 15 further comprising synchronized drive means for rotating said rotary dies at the same speed so that the dies simultaneously move their respective rollers into contact with the outer surface of the pipe and then thereafter simultaneously move their rollers out of contact with the outer surface of the pipe.

17. The machine of claim 12 in which said mandrel grooves are axial.

18. The machine of claim 12 in which said grooves are helical.

19. The machine of claim 12 wherein there are two pairs of said opposed dies disposed at 90 degree intervals about the pipe, and wherein each of said circumferential portions of said dies occupies an arc of substantially 90 degrees of the circumference of the outer surface of the pipe.

20. A machine for forming an internal enhancement on an inner surface of a metal tubular heat-exchanger pipe comprising means for advancing said pipe axially a generally cylindrical mandrel within said pipe and having a plurality of axial grooves thereon;

a plurality of pairs of opposed rotary dies in the form of wheels having respective axes disposed generally perpendicular to the axis of the heat exchanger pipe and having circumferential portions of the several rotary dies occupying respective arcs of the outer surface of the pipe so that substantially the entire circumference of the outer surface of the pipe is contacted by said dies; and means for rotating said rotary dies so that said circumferential portions thereof roll into contact with said pipe when said pipe is being advanced;

wherein said rotary dies each carry a plurality of circumferential rollers which contact the outer surface of said pipe in turn as the dies rotate;

further comprising synchronized drive means for rotating said rotary dies at the same speed so that the dies simultaneously move their respective rollers into contact with the outer surface of the pipe and then thereafter simultaneously move their rollers out of contact with the outer surface of the pipe; and in which said drive means rotates said dies in the direction so that the rollers thereof that contact the pipe move against the direction of movement of the pipe relative to the mandrel.

* * * * *